US006944982B2

(12) United States Patent
Schroeter et al.

(10) Patent No.: US 6,944,982 B2
(45) Date of Patent: Sep. 20, 2005

(54) FLAME SIMULATING APPARATUS

(75) Inventors: Wolfgang Schroeter, Midhurst (CA); Cliff Lilley, Anten Mills (CA); Jeremy Kurtin, Oro Station (CA)

(73) Assignee: Napoloen Systems and Developments Inc., Barrie (CA)

( * ) Notice: Subject to any disclaimer, the term of this patent is extended or adjusted under 35 U.S.C. 154(b) by 52 days.

(21) Appl. No.: 10/256,913

(22) Filed: Sep. 27, 2002

(65) Prior Publication Data

US 2004/0060213 A1 Apr. 1, 2004

(51) Int. Cl.[7] ..... G09F 19/00
(52) U.S. Cl. ..... 40/428; 392/348; 472/65
(58) Field of Search ..... 40/428; 362/92, 362/96, 806; 392/348; 472/65

(56) References Cited

U.S. PATENT DOCUMENTS

| | | | | |
|---|---|---|---|---|
| 643,493 | A | 2/1900 | Fuller | |
| 662,708 | A | 11/1900 | Carter | |
| 1,254,790 | A | 1/1918 | Fuller | |
| 1,843,279 | A | 2/1932 | Gritt | |
| 1,867,740 | A | 7/1932 | Guy | |
| 1,992,540 | A | 2/1935 | Newton | |
| 2,285,535 | A | 6/1942 | Schlett | |
| 3,395,475 | A | 8/1968 | Moss | |
| 3,395,476 | A | 8/1968 | Moss et al. | |
| 3,603,013 | A | 9/1971 | Reed et al. | |
| 3,636,307 | A | 1/1972 | Pearce | |
| 3,699,697 | A | 10/1972 | Painton | |
| 3,742,189 | A | 6/1973 | Conroy et al. | |
| 4,573,905 | A | 3/1986 | Meyers | |
| 4,890,600 | A | 1/1990 | Meyers | |
| 4,965,707 | A | 10/1990 | Butterfield | |
| 5,195,820 | A | 3/1993 | Rehberg | |
| 5,642,580 | A | 7/1997 | Hess et al. | |
| 6,047,489 | A | 4/2000 | Hess et al. | |
| 6,162,047 | A | 12/2000 | Hess | |
| 6,269,567 | B1 * | 8/2001 | MacPherson et al. | 40/428 |
| 6,393,207 | B1 | 5/2002 | Martin et al. | |
| 2002/0139021 | A1 * | 10/2002 | Hess et al. | 40/428 |
| 2002/0152655 | A1 * | 10/2002 | Merrill et al. | 40/428 |
| 2002/0170215 | A1 * | 11/2002 | Mix et al. | 40/428 |
| 2003/0046837 | A1 * | 3/2003 | Hess | 40/428 |
| 2003/0110671 | A1 * | 6/2003 | Hess | 40/428 |
| 2004/0181983 | A1 | 9/2004 | Hess et al. | |

FOREIGN PATENT DOCUMENTS

| | | |
|---|---|---|
| CA | 2175442 | 12/1998 |
| CA | 2295459 | 1/2000 |
| EP | 0611921 | 9/1999 |
| GB | 1024047 | 3/1966 |
| GB | 1088577 | 10/1967 |
| GB | 1164143 | 9/1969 |
| GB | 2151772 | 7/1985 |

* cited by examiner

*Primary Examiner*—Gary C. Hoge
(74) *Attorney, Agent, or Firm*—Tarolli, Sundheim, Covell & Tummino L.L.P.

(57) ABSTRACT

A flame simulating apparatus to simulate flames emanating from a wood or fossil fuel burning fire. The flame simulating apparatus includes a light source, a light reflecting element, and a fire simulation screen. The light reflecting element produces a moving and generally random pattern of reflected light when light is cast upon it by the light source. The fire simulation screen has the image of a fire thereon and is positioned so that reflected light from the light reflecting element is cast upon its rear surface. The fire simulation screen includes at least one portion that is at least partially translucent such that light cast upon the partially translucent portion by the light reflecting element is diffused and at least partially passes through the translucent portion to present a moving flame image when viewed from a position in front of the fire simulation screen.

17 Claims, 8 Drawing Sheets

FLAME SIMULATING APPARATUS

FIELD OF THE INVENTION

This invention relates to an apparatus for simulating the flames of a wood or fuel burning fire or fireplace, and in one embodiment an electric fireplace or stove incorporating such a flame simulating apparatus.

BACKGROUND OF THE INVENTION

With the growing popularity of fireplaces and stoves in both residential and commercial settings, many have directed their attention to the development of non-combustion fireplaces and stoves that present the visual image of an actual fire but without the variety of negative aspects that are associated with the burning of wood or fossil fuels and the devices needed to contain and control a burning fire and its by-products. Typically such fireplaces or stoves are electric in nature and often contain an electric heating element that may be used to generate heat in order to further simulate the overall effect of a more traditional fuel burning fireplace or stove. Part of the attractiveness of such non-combustion appliances, and to a large extent for the reason for their gain in popularity, is the ease by which they may be installed and the fact that they neither require a source of combustible fuel nor do they require a chimney or a fresh air intake vent.

As a result of the popularity of electric fireplaces and stoves a considerable amount of effort has been undertaken in an attempt to create a flame simulating apparatus that presents the visual affects of a traditional or fuel burning fire. To this end others have suggested the use of holographic images, diffusion screens, and similar assemblies that are meant to create the appearance of a realistic "flame". Typically such prior devices create a flickering light pattern that is meant to simulate the image of flames emanating upwardly from a fire. While many such devices present a relatively pleasing simulated flame, their ability to mimic the visual appearance of a real fire is generally best when viewed at a distance. Often their visual appeal diminishes considerably when viewed from close distance, as is often the case in standard residential living, family, or recreation rooms. As a result there continues to be a need for a flame simulating apparatus that may be utilized with a non-burning fireplace or stove that presents a pleasing and high quality image mimicking or simulating flames emanating from a wood or fossil fuel fire, when viewed both at distance and from a close proximity.

SUMMARY OF THE INVENTION

The invention therefore provides a flame simulating apparatus, and in one embodiment such an apparatus incorporated within an electric fireplace or stove, that provides a realistic and visually pleasing simulation of what are often referred to as the dancing flames of a wood or fossil fuel fire.

Accordingly, in one of its aspects the invention provides a flame simulating apparatus to simulate flames emanating from a wood or fossil fuel burning fire, the flame simulating apparatus comprising a light source; a light reflecting element; a diffusing panel, said diffusing panel having a front and a rear surface and positioned relative to said light source and said light reflecting element such that light from said light source is reflected by said light reflecting element onto said rear surface of said diffusing panel, said diffusing panel having at least one portion that allows light to pass through said panel; and, a fire simulation screen containing the image of a fire thereon, said screen positioned adjacent to said front surface of said diffusing panel and having at least one portion that allows light reflected onto and through said diffusing panel by said light reflecting element to pass through said screen to create the appearance of moving flames emanating from said image of said fire on said screen.

In a further aspect the invention provides in combination, an electric fireplace or stove and a flame simulating apparatus to simulate flames emanating from a wood or fossil fuel burning fire, the combination comprising an exterior housing having front, back, top, bottom and side surfaces, and having a generally hollow open interior compartment; a simulated fire log set positioned within the interior of said housing; a light source; a light reflecting element; means to move said light reflecting element such that light from said light source that is cast upon said light reflecting element is reflected away from said light reflecting element in a generally random pattern; a diffusing panel, said diffusing panel having a front and a rear surface and extending at least partially across said open interior of said housing, said diffusing panel positioned behind said simulated log set and between said light reflecting element and said front of said housing such that at least a portion of the light reflected by said light reflecting element is cast upon said diffusing panel; and, a fire simulation screen having a rear surface and having a front surface, said fire simulation screen having received thereon the image of a fire and positioned with its rear surface generally adjacent to said front surface of said diffusing panel, said fire simulation screen having at least one portion that allows light reflected onto and through said diffusing panel by said light reflecting element to pass through said screen creating the appearance of moving flames emanating from said image of said fire on said screen.

In another aspect the invention provides a flame simulating apparatus to simulate flames emanating from a wood or fossil fuel burning fire, the flame simulating apparatus comprising a light source; a light reflecting element; a diffusing panel, said diffusing panel being at least partially translucent and having a front and rear surface, said diffusing panel positioned relative to said light source and said light reflecting element such that light from said light source may be reflected by said light reflecting element onto said rear surface of said diffusing panel; and, a fire simulation screen having a rear surface and having a front surface with the image of a fire thereon, said fire simulation screen positioned generally adjacent to said front surface of said diffusing panel and having areas of varying relief upon its front surface thereby providing a 3-dimensional appearance to said image of said fire.

The invention also provides a flame simulating apparatus to simulate flames emanating from a wood or fossil fuel burning fire, the flame simulating apparatus comprising a light source; a light reflecting element, said light reflecting element producing a moving and generally random pattern of reflected light when light is cast upon said light reflecting element by said light source; and, a fire simulation screen having the image of a fire thereon, said fire simulation screen having a front and a rear surface and positioned such that light from said light source may be reflected by said light reflecting element and cast upon said rear surface of said fire simulation screen, said fire simulation screen including at least one portion that is at least partially translucent such that light cast upon said partially translucent portion by said light reflecting element is diffused by said partially translucent portion, said diffused light at least partially passing through said translucent portion of said fire simulation screen to present a moving flame image when viewed from a position in front of said fire simulation screen.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

Figure 1:
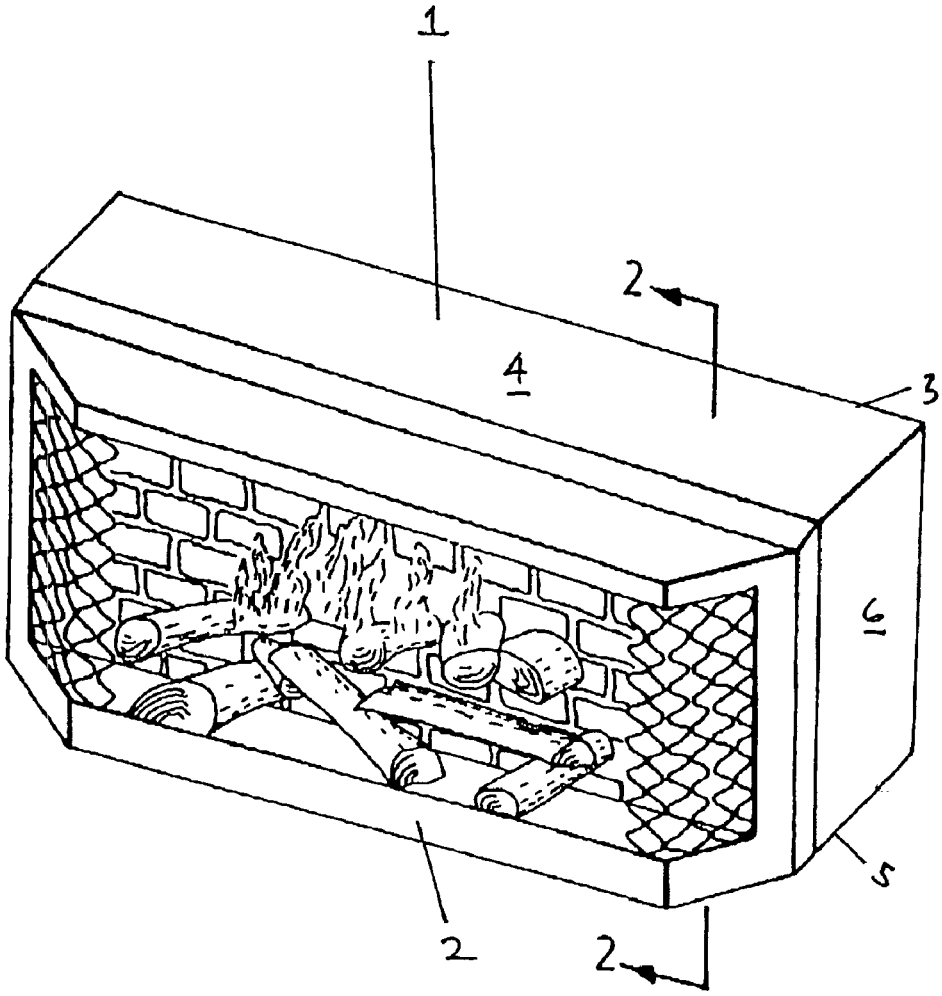
FIG. 1 is a front perspective view of an electric fireplace having embodied therein the flame simulating apparatus in accordance with the present invention.
Figure 2:
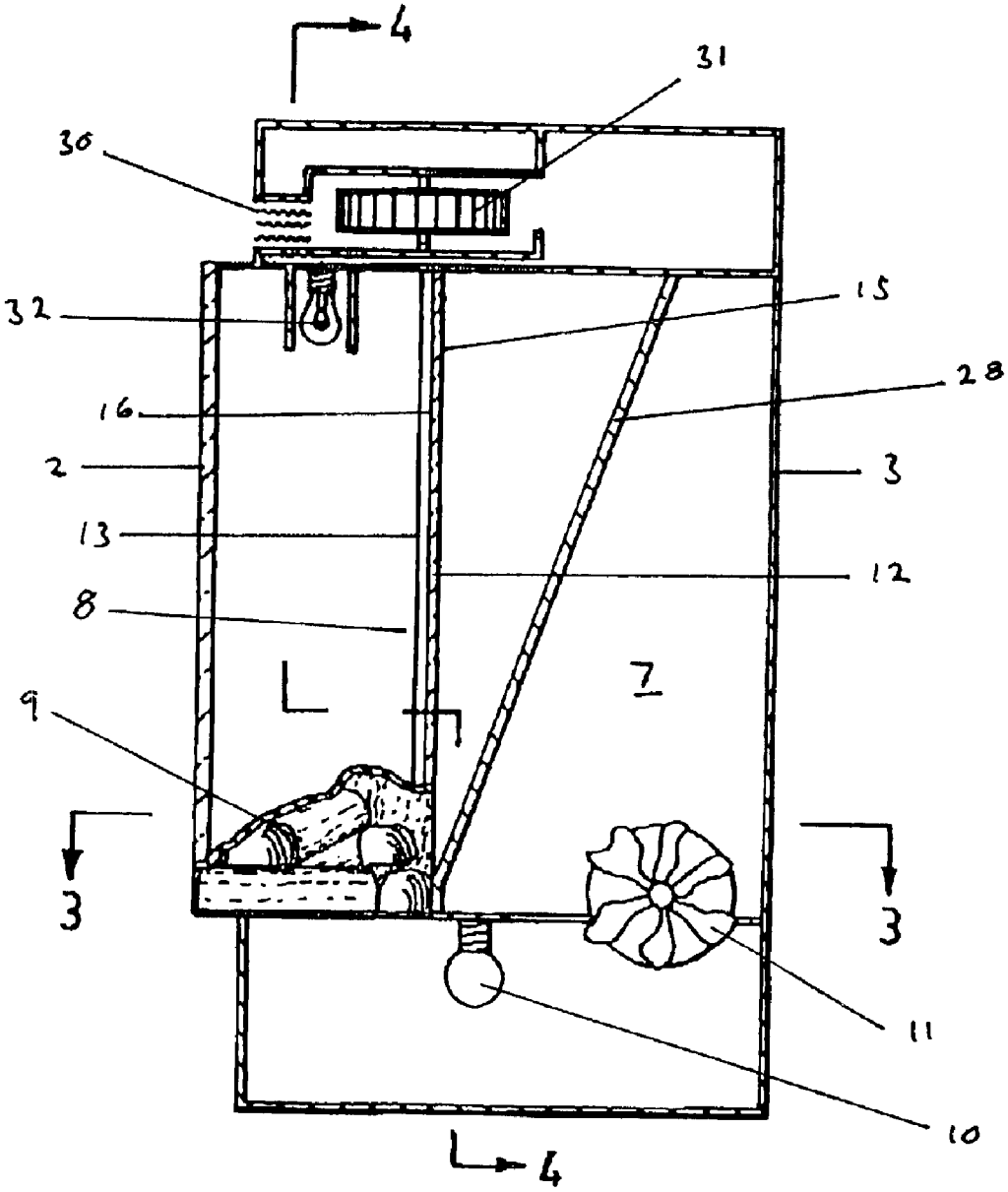
FIG. 2 is a side sectional view taken along the line 2—2 of FIG. 1.

The present invention may be embodied in a number of different forms. However, the specification and drawings that follow describe and disclose only some of the specific forms of the invention and are not intended to limit the scope of the invention as defined in the claims that follow herein.

In the accompanying drawings, the flame simulating apparatus in accordance with one preferred embodiment of the invention is shown for purposes of illustration as it would be used in conjunction with an electric fireplace. However, it will be appreciated that while it is expected that incorporation into an electric fireplace or stove is likely to be the primary use of the invention, it is not necessarily the only use. For that reason the accompanying drawings and the description of the electric fireplace as set forth below should be considered to represent one application of the invention, but not necessarily the only application.

In the drawings that follow there is shown a fireplace housing 1 that is comprised generally of a front surface 2, a back surface 3, a top surface 4, a bottom surface 5, and opposed side surfaces 6. As is common in the manufacturing of such fireplaces, the front, back, top, bottom and side surfaces generally define a hollow open interior compartment 7 that houses and retains the primary components of the fireplace, and in this instance the flame simulating apparatus (noted generally by reference numeral 8) in accordance with a preferred embodiment of the invention. Also situated within hollow interior 7 is a simulated fire log set 9 which, as will be discussed in more detail later, may be a separate element or may comprise a portion of flame simulating apparatus 8. Simulated fire log set 9 may be made of any one of a wide variety of materials (such as wood, ceramic, or synthetic materials) and is designed to mimic the logs and the embers of a wood or coal burning fire.

With specific reference to FIGS. 2 through 8, the structure and operation of flame simulating apparatus 8 in accordance with a preferred embodiment of the invention will now be described in detail. Flame simulating apparatus 8 is comprised generally of a light source 10, a light reflecting element 11, a diffusing panel 12, and a fire simulation screen 13. Light source 10 includes one or more light bulbs 14 that are operatively connected to the electrical system of fireplace housing 1 (not shown) such that they become illuminated upon operation of the fireplace. Light bulbs 14 are positioned in a manner such that they direct light onto light reflecting element 11, which in turn reflects the light from light source 10 onto the rear surface 15 of diffusing panel 12. In one embodiment of the invention light bulbs 14 are positioned that they are located beneath simulated fire log set 9 so that light from bulbs 14 may also be used to at least partially illuminate the fire log set to present the appearance of glowing embers within the bed of a fire. Depending upon the desired effect, light bulbs 14 may be clear or coloured. Alternately a coloured filter may be used to cast light of different colours either onto light reflecting element 11 or through simulated fire log set 9.

In one embodiment of the invention diffusing panel 12 is comprised of glass, plexiglass or a similar material having light diffusion or dispersion characteristics. Diffusing panel 12 is preferably formed such that it is at least partially translucent to allow light to pass through the panel. It will be appreciated that depending upon the overall visual effect that is desired, all or a portion of diffusing panel 12 may be constructed to allow light to pass therethrough. In the attached drawings, diffusing panel 12 is a glass plate extending substantially across the hollow open interior of fireplace housing 1 and having a front surface 16 facing the front of the fireplace with a rear surface 15 directed towards the back of the fireplace housing. In this embodiment the diffusing or disbursing properties of the glass plate are enhanced through sandblasting its rear surface. Accordingly, light that is cast upon the diffusing panel will be disbursed across a sizeable area of the glass plate tending to present a soft and glowing image when viewed from the front of the fireplace housing.

In order to simulate the appearance of a burning fire within housing 1, fire simulation screen 13 contains on its surface the image of a fire and is positioned adjacent to front surface 16 of diffusing panel 12. In one embodiment of the invention fire simulation screen 13 is comprised of a sheet of generally transparent film material (for example mylar film with a thickness of approximately 0.006 in.) that is secured to the front surface of diffusing panel 12 through the use of an adhesive, through mechanical fasteners, or through cohesion. Printed, silk screened, or otherwise applied to the front or rear surface of the film is the image of a burning fire, as shown more specifically in FIG. 6. Here the image that is applied to the film is that of a wood burning fire that includes burning logs 17 and fire bricks 18 such that the overall image applied to the film is that of the interior of a wood burning fireplace. However, depending upon the effect that is desired the image may alternatively be that of a coal burning fire. To enhance the realistic appearance of the image, an actual photograph of a wood burning fireplace may be imprinted or silk screened onto screen 13.

Figure 6:
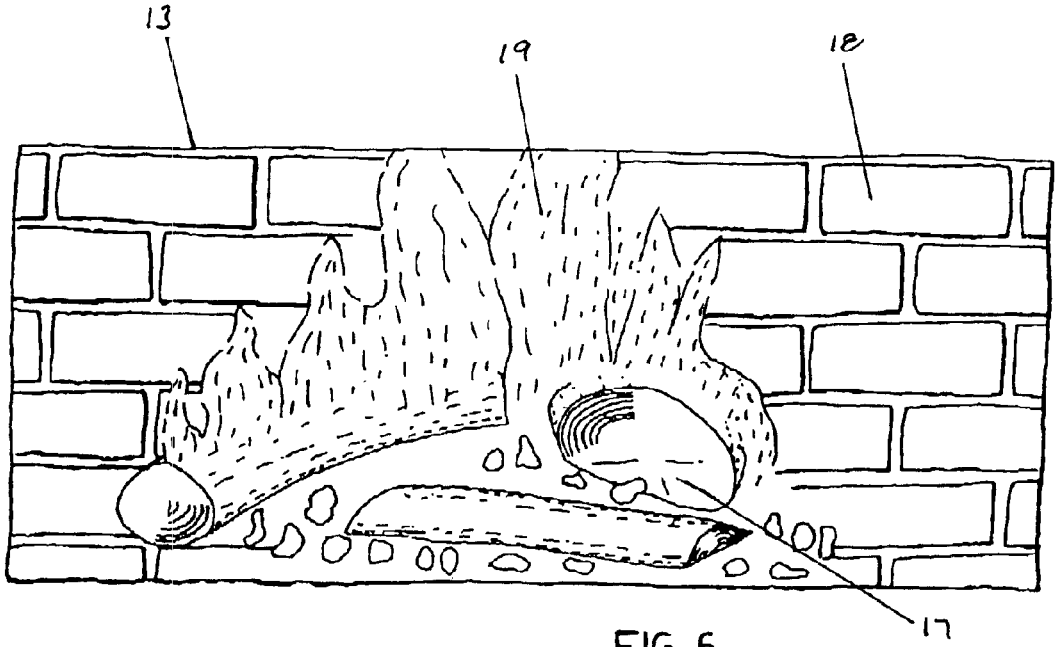
FIG. 6 is a front detail view of the diffusing panel of the electric fireplace shown in FIG. 1 where the diffusing panel has received thereon the image of a fire.

As is also shown in FIG. 6, fire simulation screen 13 preferably includes one or more portions 19 that are either transparent, substantially transparent, or translucent to allow light that is reflected onto diffusing panel 12 to pass through screen 13 and to thereby create the appearance of moving or licking flames emanating from the image of the fire on the screen. Once again depending upon the overall effect desired, portions 19 may be clear or may be coloured to provide the light passing therethrough with a yellow or orange tint and to further enhance the illusion of a real fire. Similarly, other portions of the image imprinted upon screen 13 (for example, embers on burning logs 17) may be coloured or of a translucent nature such that light diffusing panel 12 may be utilized to illuminate other visual aspects of the image of the fire.

It will be appreciated and understood that the function of light reflecting element 11 is to cast a moving pattern (and preferably a somewhat random pattern) of light upon diffusing panel 12 so as to provide the image of a moving flame emanating from the image of the fire imprinted upon fire simulation screen 13. A variety of such light reflecting elements have been proposed and are commonly used. In the embodiment shown in FIGS. 2 through 10, light reflecting element 11 is comprised generally of a horizontally mounted rotating shaft 20 located behind diffusing panel 12. Extending outwardly from the surface of shaft 20 is a plurality of light reflecting members or fingers 21 comprised of a highly reflective material. Typically light reflecting members 21 would be situated about the circumference of shaft 20 and extend outwardly therefrom at a variety of different angles relative to each other and relative to the longitudinal axis of shaft 20. In this manner light that is cast upon reflecting element 11 by light source 10 is scattered across the rear surface of diffusing panel 12 in a generally random pattern. The appearance of a moving flame is accomplished by rotating shaft 11 through the use of a small electric motor (not shown). Using FIG. 2 as a frame of reference, turning shaft 11 in a clockwise direction will cast reflected light upon diffusing panel 12 in a manner that simulates the upward movement of flames away from the image of the fire on screen 13.

Figure 3:
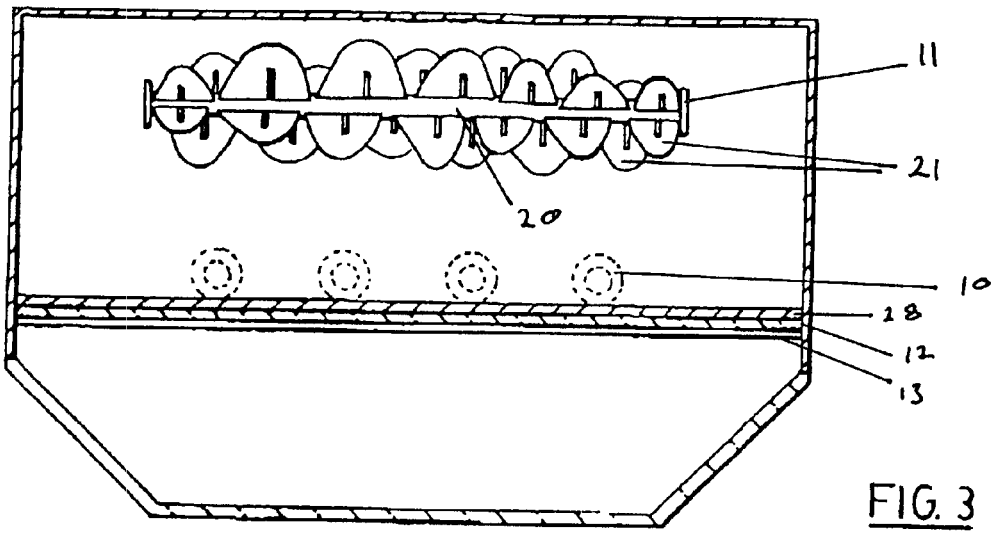
FIG. 3 is a horizontal sectional view taken along the line 3—3 of FIG. 2.
Figure 4:
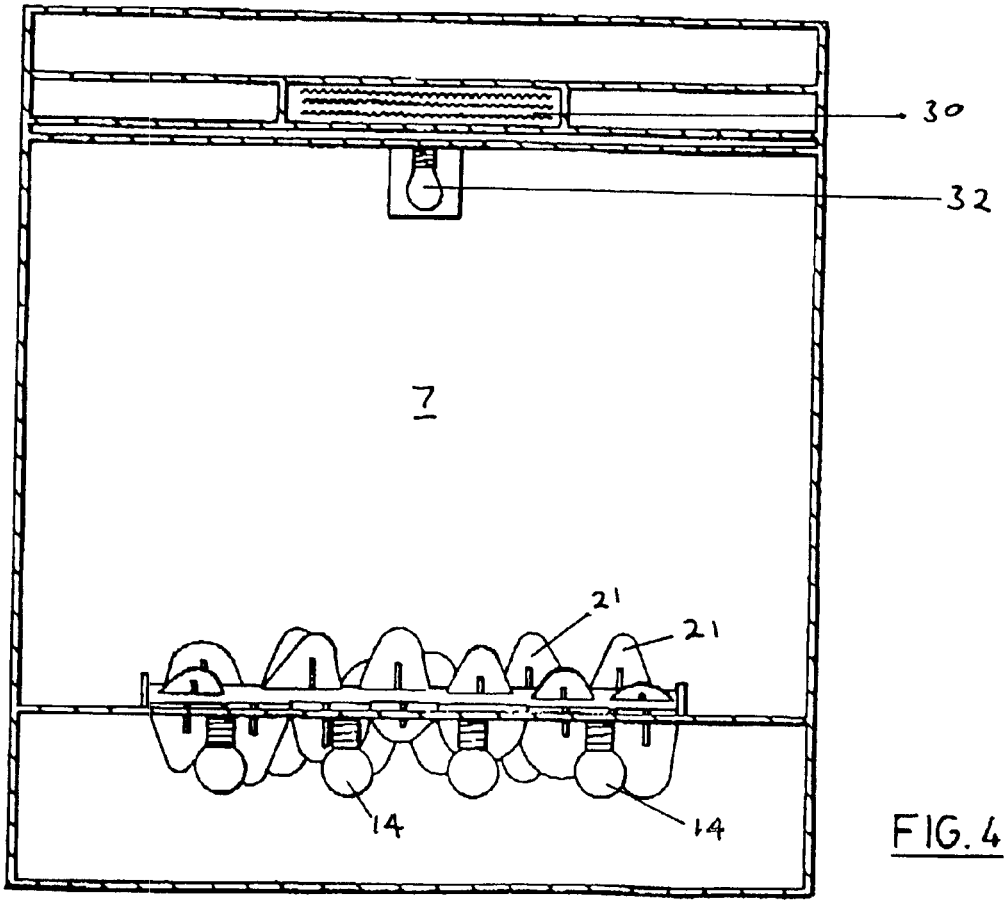
FIG. 4 is a vertical sectional view of the electric fireplace shown in FIG. 2 taken along the line 4—4 and wherein the flaming log set of the fireplace has been removed.
Figure 5:
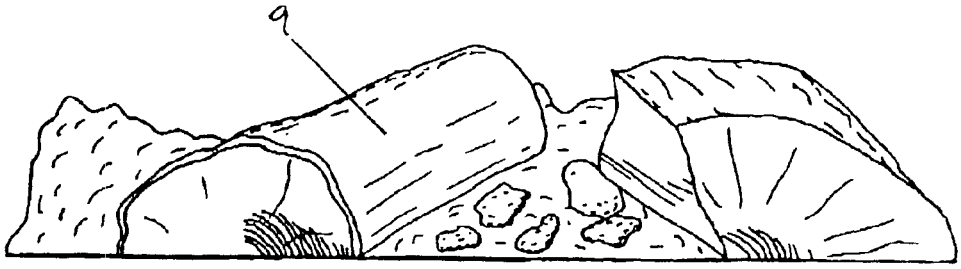
FIG. 5 is a front view of the log set of the electric fireplace shown in FIG. 1.
Figure 8:
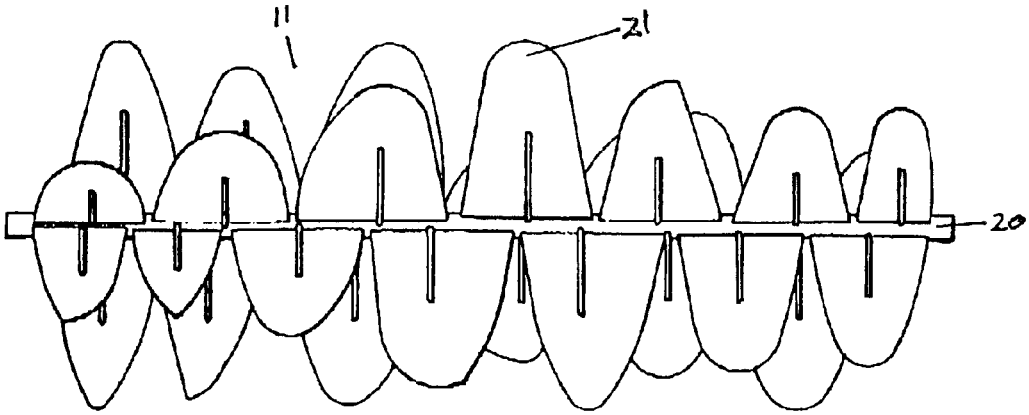
FIG. 8 is a detail view of the flicker element of the electric fireplace shown in FIG. 1.

As seen in FIGS. 3, 4, and 8, the light reflecting members 21 may comprise a plurality of planer members extending axially along the rotating shaft 20 and radially from the rotating shaft. The light reflecting members 21 extend at random radial locations about the rotating shaft 20. The base of each light reflecting member 20 forms a linear connection along the rotating shaft 20. The light reflecting members 21 may have random axial and radial dimensions so that the reflected light produces a "natural-looking" simulated flame. As seen in the Figures, the light reflecting members 21 may have various non-uniform shapes such as parabolic, triangular, curvilinear, arcuate, circular, or any combination thereof.

Figure 11:
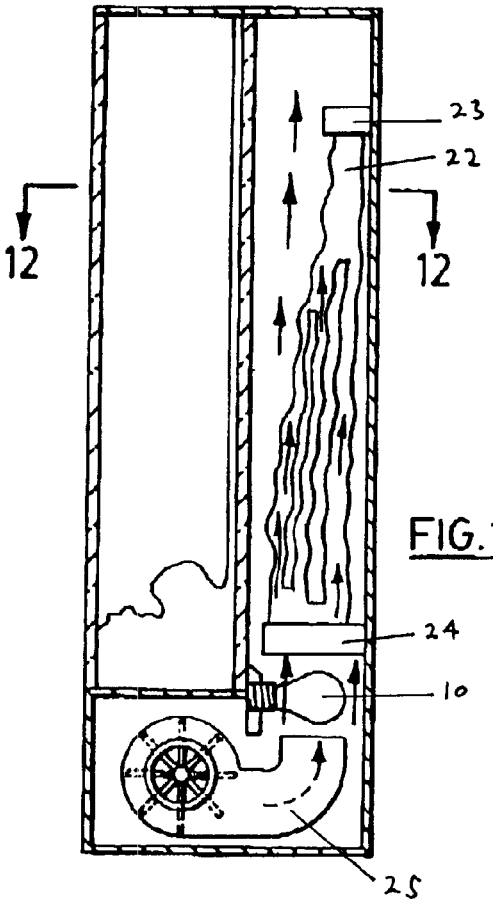
FIG. 11 is a side sectional view of an alternate embodiment of the electric fireplace shown in FIG. 1.
Figure 13:
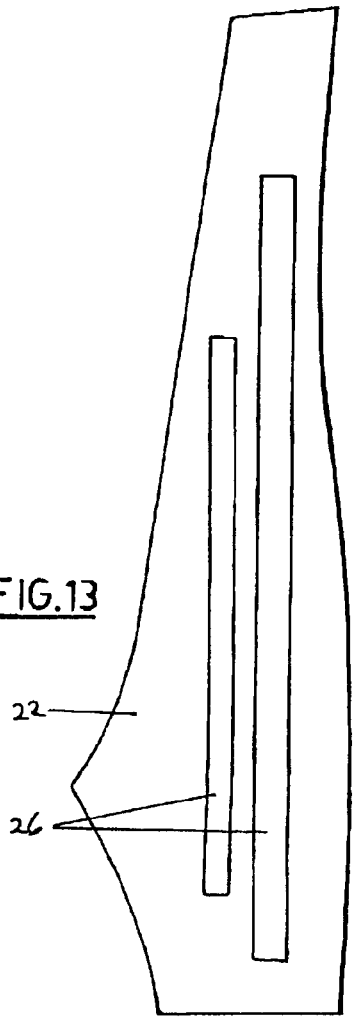
FIG. 13 is a side sectional detail view of one of the ribbon elements of the embodiment of the electric fireplace shown in FIG. 11.
Figure 12:
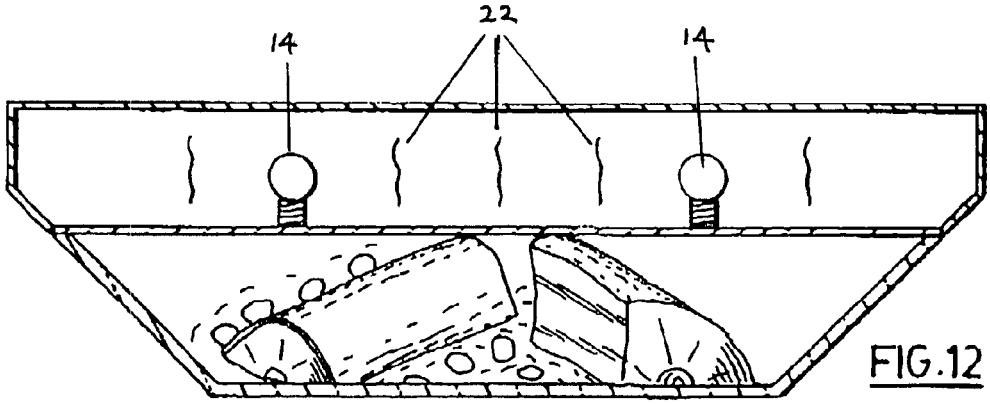
FIG. 12 is a horizontal sectional view taken along the line 12—12 of the electric fireplace shown in FIG. 11.

In an alternate embodiment of the invention (see FIGS. 11 through 13) light reflecting element 11 is comprised of a plurality of reflecting members that are generally in the form of a number of ribbons 22 that extend between upper and lower supports 23 and 24 within housing 1. Ribbons 22 are preferably comprised of a material that allows them to flutter under the influence of an air current created by a fan 25. In this regard, the individual ribbons may be made of silk, synthetic silk-like material, mylar, thin light-weight nylon, or similar materials. The exterior of the ribbons is itself either light reflecting or contains a light reflecting insert such that light from light source 10 may be reflected from the ribbons to diffusing panel 12. As the ribbons ripple or undulate in the air current provided by fan 25, light that is reflected from them onto diffusing panel 12 has the effect of emulating a simulated flame rising from the image of the fire upon screen 13. The effect and randomness of the light that is reflected may be enhanced by tapering the upper end of the ribbons and/or through the inclusion of one or more longitudinal slits 26 running along the length of the ribbon. Slit or slits 26 tend to have the effect of enhancing the undulating or rippling movement of the ribbon under the influence of the air current.

Figure 10:
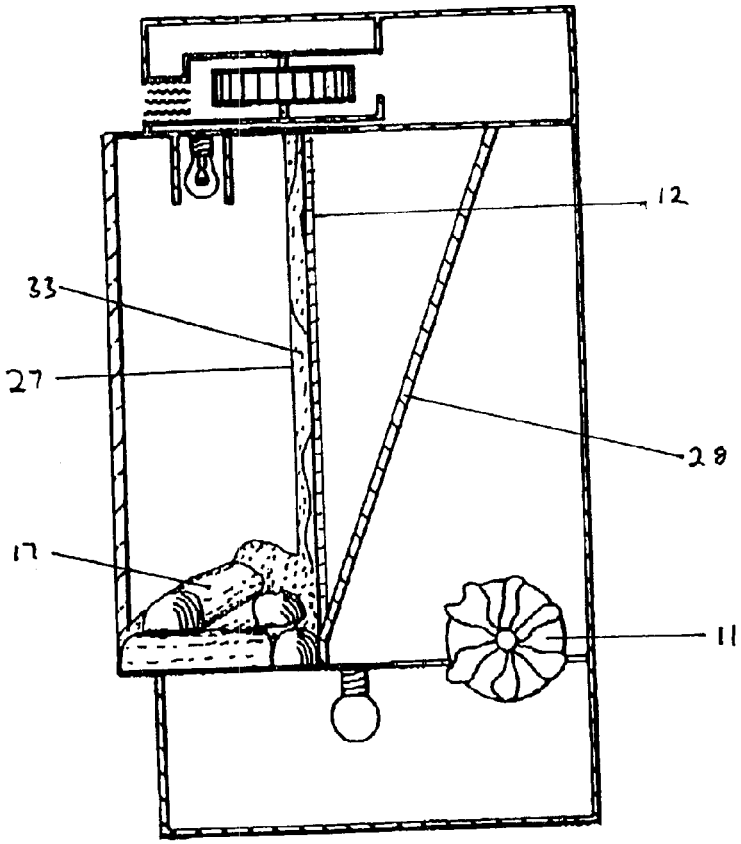
FIG. 10 is a side sectional view of an electric fireplace incorporating the flaming log set of FIG. 9.
Figure 9:
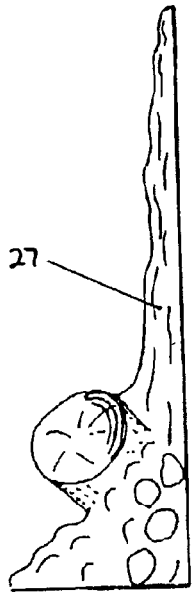
FIG. 9 is a side sectional view of an alternate embodiment of the flaming log set.

Yet a further embodiment of the invention is shown in FIGS. 9 and 10. Here, fire simulation screen 13 is comprised of a solid and rigid panel 27 that has a varying thickness and has areas of varying relief upon its front surface. As in the previous embodiment, panel 27 also contains the image of a fire on its surface. The varying thickness and relief helps to generate a more realistic look and provides a 3-dimensional appearance to the fire. It is expected that in most instances panel 27 would be moulded from a plastic or synthetic material (for example polystyrene) with at least a portion of it being at least partially translucent to permit light passing through diffusing panel 12 to be viewed from in front of simulation screen 13, creating the appearance of flames moving upwardly from the image of the fire on the screen. In the particular embodiment of the invention shown in FIGS. 9 and 10, simulated fire log set 9 and fire simulation screen 13 are unitarily formed or molded from polystyrene or a similar material. In this instance at least a portion of the log set of panel 27 is preferably translucent to allow for light to pass therethrough and to present the illusion of glowing embers at the base of the fire.

Figure 7:
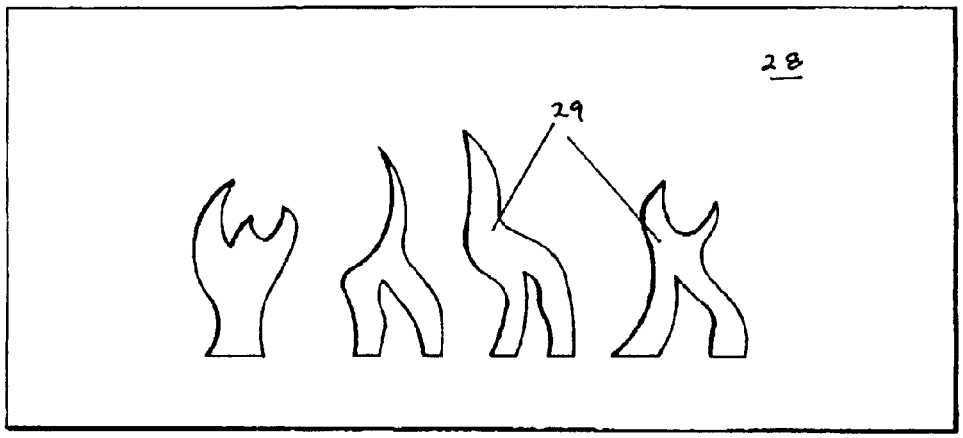
FIG. 7 is a front detail view of the light shield of the electric fireplace shown in FIG. 1.

The moving flame image projected upon diffusing panel 12 may be yet further enhanced through the use of a light shield 28 positioned between diffusing panel 12 and light reflecting element 11. As shown in FIG. 7, light shield 28 is preferably opaque except for one or more flame shaped portions 29 that allow for the passage of light from reflecting element 11 through the shield in pre-defined areas. Depending upon the visual effect that is desired, openings 29 may be actual cut outs or openings through light shield 28 or, alternatively, may be transparent or translucent sections. It will be appreciated that placing light shield 28 between light reflecting element 11 and diffusing panel 12 will have the effect of causing light that is cast upon diffusing panel 12 to be in the general form or shape of a flame. It has been found that tilting the top of the shield backwardly and away from diffusing panel 12 has the effect of disbursing light that shines through the upper portion of openings 29 over a greater area and creates the appearance of flames having a reduced intensity toward their upper ends, creating a more realistic flame effect. In addition the shield may be constructed with an open or transparent bottom portion to allow light to be cast upon the rear portion of the fire log set to help create the image of glowing embers within the log set. Alternatively, shield 28 may be positioned within housing 1 with its lower edge above the fire log set so that light can be cast directly on the rear surface of log set 9.

The rotation of light reflecting element 11 provides the appearance that the flame is moving upwardly away from the image of the fire on screen 13. Where flame shaped portions 29 are transparent or translucent sections within shield 28, coloured filters may be utilized in order to cast light of a desired colour across the rear surface of diffusing panel 12. In the embodiment of the invention where light reflecting element 11 is comprised of one or more ribbons, light shield 28 may be redundant as the undulating movement of the ribbons and their shape will generally create a similar effect to that of the combination of a rotating light reflecting element and a light shield with flame shaped openings.

In a further embodiment of the invention the use of a separate and distinct diffusing panel 12 may be eliminated such that light from reflecting element 11 is cast directly upon fire simulation screen 13. In this embodiment simulation screen 13 may be comprised of a thin sheet of transparent film-like material that is held in a generally vertical orientation within housing 1 by a set of upper and lower brackets (not shown). Alternatively, screen 13 may be comprised of a solid and rigid panel 27 that may have a varying thickness and areas of the varying relief upon its front surface. It will be appreciated by those skilled in the art that such a panel may be formed using one of a variety of different manufacturing methods and with a variety of different materials while staying within the broad scope of the invention.

Figure 14:
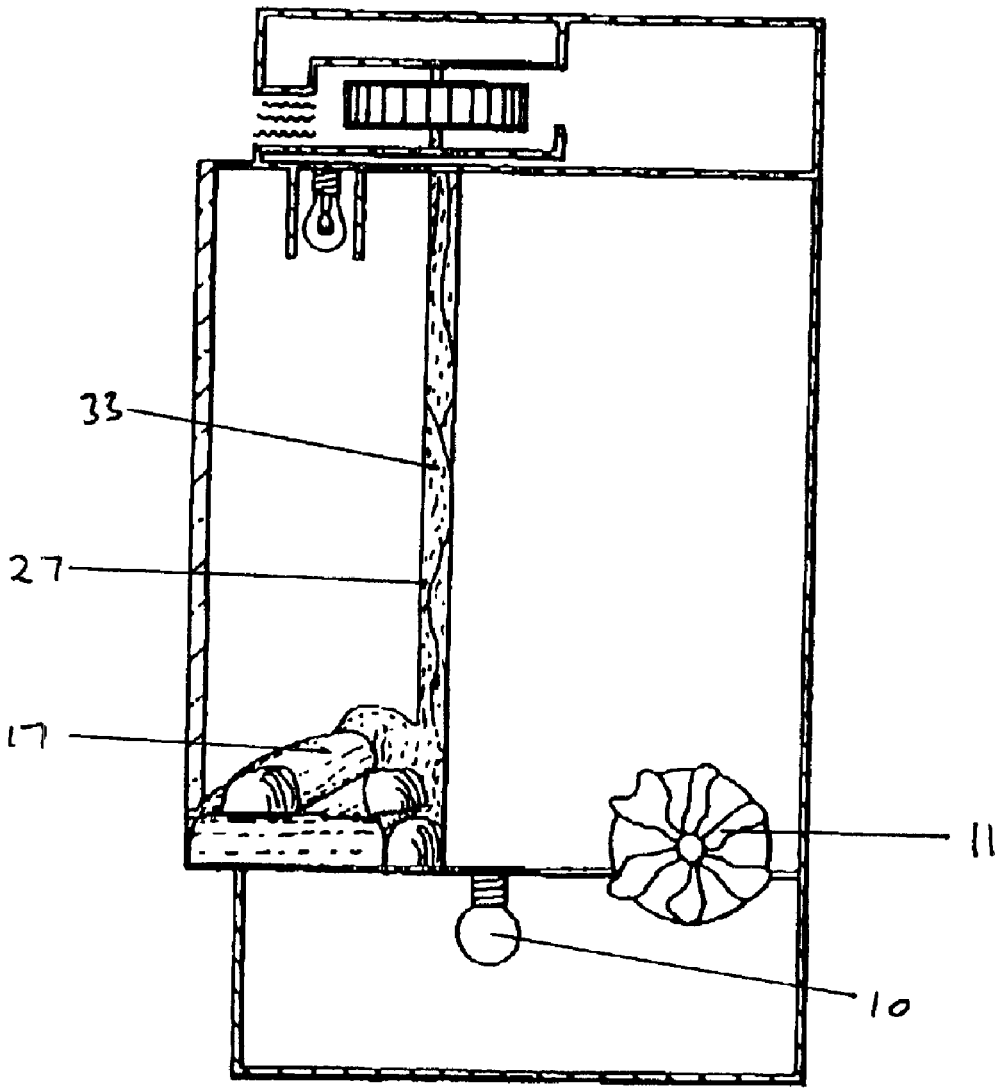
FIG. 14 is a side sectional view of an electric fireplace having embodied therein yet a further embodiment of the present invention.

In the particular embodiment of the invention that is shown in FIG. 14, panel 27 is formed using a generally flat sheet of polystyrene having a thickness of approximately 0.025 inches. The image of a burning fire (with or without the image of a burning log set or coal bed, as desired) is printed, silk screened or otherwise applied to the generally flat panel. Thereafter, the panel is subjected to a vacuum molding process to produce a 3-dimensional effect with areas of varying relief across the surface of the panel. These areas of varying relief, in combination with the image of a burning fire on the panel, provide a realistic and 3-dimensional image of an actual fire when viewed from in front of the panel.

At least a portion 33 of panel 27 is preferably translucent to allow light from light source 10 to pass through the panel at desired locations and in predefined shapes. Typically translucent portions 33 of panel 27 will have the general overall shape of one or more flames emanating upwardly from a fire log set (or coal bed as the case may be) and may be at least partially tinted to provide a reddish or orange colouration to light passing therethrough. Translucent portions 33 will also have a diffusing effect upon light that is cast upon them, thereby producing a softer and somewhat glowing image when viewed from a position in front of panel 27. If desired, tint used in the translucent portions of panel 27 could be graduated such that both the colour and the intensity of the colour becomes somewhat washed out in an upward direction. In this manner the visual effect presented when viewed from in front of panel 27 more realistically resembles that of flames of a burning fire.

It will therefore be appreciated that through the combination of panel 27, translucent portions 33, light source 10 and reflecting element 11 a realistic image of an actual fire will be presented when viewed from in front of panel 27. The movement of light reflecting element 11 will cause light to be cast across the rear surface of panel 27 in a moving and somewhat random pattern, thereby creating a moving flame effect as light passes through translucent portions 33. The diffusing capacity of portions 33 provides a soft and glowing image consistent with lapping flames streaming upwardly from a fire.

In addition, and as shown in the attached drawing, positioning light reflecting element 11 in a horizontal plane that is generally beneath panel 27 causes light to be directed from element 13 onto the rear surface of panel 27 at a relatively steep angle. This inclined angle at which the light is cast across panel 27 has the effect of reducing the intensity of the light toward the top of the simulated flame, once again creating a somewhat washed-out effect to more realistically resemble an actual fire. Preferably the portions of panel 27 through which light is allowed to be transmitted are sufficiently translucent to diffuse the light creating a softer and somewhat glowing image. Constructing panel 27 in this manner thus removes the necessity for a separate diffusing panel and/or light shield. Accordingly, an equally pleasing visual image may be presented with a mechanically simpler and more economic structure.

Finally, it will be appreciated that when flame simulating apparatus 8 is used in conjunction with an electric fireplace or stove, the fireplace or stove would typically also include a heater element 30, fan 31, a nightlight 32, and various other features that are commonly incorporated within such devices.

It is to be understood that what has been described are the preferred embodiments of the invention and that it may be possible to make variations to these embodiments while staying within the broad scope of the invention. Some of these variations have been discussed while others will be readily apparent to those skilled in the art.

What is claimed is:

1. A flame simulating apparatus to simulate flames emanating from a wood or fossil fuel burning fire, the flame simulating apparatus comprising:

a light source;

a light reflecting element;

a fire simulation screen containing the image of a fire thereon, said fire simulation screen having at least one portion that allows light reflected by said light reflecting element to create the appearance moving flames emanating from said image of said fire on said screen, said light reflecting element comprising an elongate rotating shaft to which is attached a plurality of planar, arcuately shaped light reflecting members such that light cast upon said light reflecting members is reflected outwardly in a generally randomized pattern when said light reflecting element is rotated, said light reflecting members being spaced at random radial locations about said rotating shaft, said light reflecting members being spaced at random axial locations along said rotating shaft.

2. The device as claimed in claim 1 including a diffusing panel, said diffusing panel having a front and a rear surface and positioned relative to said light source and said light reflecting element such that light from said light source is reflected by said light reflecting element onto said rear surface of said diffusing panel, said diffusing panel having at least one portion that allows light to pass therethrough and onto said fire simulation screen.

3. The device as claimed in claim 2 further including a light shield, said light shield being generally opaque and having at least one portion that allows light to pass therethrough and that is configured generally in a form to emulate the shape of a flame, said light shield positioned between said diffusing panel and said light reflecting element such that light that is cast upon said diffusing panel by said light reflecting element is generally in the shape of a flame.

4. The device as claimed in claim 2 wherein said fire simulation screen is comprised of a sheet of generally transparent film material onto which is received said image of a fire, said sheet of film material secured to said diffusing panel.

5. The device as claimed in claim 4 wherein said image on said film material includes the image of at least a partial fire log set.

6. The device as claimed in claim 2 wherein said diffusing panel is comprised of a sheet of glass, said glass having at least one of its front and rear surfaces sandblasted in order to enhance its diffusing characteristics.

7. In combination, an electric fireplace or stove and a flame simulating apparatus to simulate flames emanating from a wood or fossil fuel burning fire, the combination comprising:

(i) an exterior housing having front, back, top, bottom and side surfaces, and having a generally hollow open interior compartment;

(ii) a simulated fire log set positioned within the interior of said housing;

(iii) a light source;

(iv) a light reflecting element;

(v) means to move said light reflecting element such that light from said light source that is cast upon said light reflecting element is reflected away from said light reflecting element in a generally random pattern; and, (vi) a fire simulation screen having a rear surface and having a front surface, said fire simulation screen having received thereon the image of a fire, said fire simulation screen having at least one portion that allows light reflected by said light reflecting element to create the appearance of moving flames emanating from said image of said fire on said screens, said light reflecting element comprising a plurality of planar, arcuately shaped light reflecting members such that light cast upon said light reflecting members is reflected outwardly in a generally randomized pattern when said light reflecting element is rotated, said light reflecting members being spaced at random radial locations about said moving means, said light reflecting members being spaced at random axial locations along said moving means.

8. The device as claimed in claim 7 including a diffusing panel, said diffusing panel having a front and a rear surface and extending at least partially across said open interior of said housing, said diffusing panel positioned such that at least a portion of the light reflected by said light reflecting element is cast upon said diffusing panel.

9. The device as claimed in claim 8 including a light shield, said light shield being generally opaque and having at least one generally transparent portion in the shape of a flame such that light reflected from said light reflecting element is cast upon said diffusing panel in a shape emulating that of a flame.

10. The device as claimed in claim 8 wherein said screen is comprised of a sheet of generally transparent film material that is adhered to said diffusing panel.

11. The device as claimed in claim 7 wherein said image on said screen includes the image of a fire log set.

12. The device as claimed in claim 7 including a secondary light source, when activated said secondary light source illuminating said simulated fire log set and said image on said fire simulation screen.

13. The device as claimed in claim 7 including an electric heating element and a fan to allow for the heating of the environment within which said device is located.

14. A flame simulating apparatus to simulate flames emanating from a wood or fossil fuel burning fire, the flame simulating apparatus comprising:

a light source;

a light reflecting element, said light reflecting element producing a moving and generally random pattern of reflected light when light is cast upon said light reflecting element by said light source; and, a fire simulation screen having the image of a fire, said fire simulation screen positioned such that light from said light source may be reflected by said light reflecting element and cast upon said fire simulation screen, said fire simulation screen including at least one portion that is at least partially translucent such that light cast upon said partially translucent portion by said light reflecting element is diffused by said partially translucent portion, said diffused light at least partially passing through said translucent portion of said fire simulation screen to present a moving flame image emanating from said image of said fire thereon, said light reflecting element comprising an elongate rotating shaft to which is attached a plurality of planar, arcuately shaped light reflecting members such that light cast upon said light reflecting members is reflected outwardly in a generally randomized pattern when said light reflecting element is rotated, said light reflecting members being spaced at random radial locations about said rotating shaft, said light reflecting members being spaced at random axial locations along said rotating shaft.

15. The device as claimed in claim 14 wherein said fire simulation screen includes a simulated fire log set, at least a portion of said simulated fire log set being at least partially translucent to permit light generated by said light source to pass through said simulated fire log set to create the illusion of glowing members within said log set.

16. The device as claimed in claim 14 wherein said image includes the image of at least a partial fire log set.

17. The device as claimed in claim 14 wherein said image includes the image of at least a partial coal bed.

* * * * *

UNITED STATES PATENT AND TRADEMARK OFFICE

CERTIFICATE OF CORRECTION

PATENT NO. : 6,944,982 B2
DATED : September 20, 2005
INVENTOR(S) : Daniel H. Stark It is certified that error appears in the above-identified patent and that said Letters Patent is hereby corrected as shown below:

Column 8,
Line 34, after "element" insert -- and --.
Line 38, after "appearance" insert -- of --.

Column 9,
Line 33, after "said" change "screens," to -- screen, --.

Signed and Sealed this

Twenty-first Day of March, 2006

JON W. DUDAS
*Director of the United States Patent and Trademark Office*